United States Patent [19]

Kmak et al.

[11] 4,203,825

[45] May 20, 1980

[54] METHOD FOR REMOVING CORONENE FROM HEAT EXCHANGERS

[75] Inventors: Walter S. Kmak, Scotch Plains, N.J.; Charles Monzo, Sea Brook, Tex.

[73] Assignee: Exxon Research & Engineering Co., Florham Park, N.J.

[21] Appl. No.: 8,777

[22] Filed: Feb. 2, 1979

[51] Int. Cl.[2] ..... C07C 15/12; C10G 9/16; C10G 39/00

[52] U.S. Cl. ..... 208/48 R; 203/4; 203/87; 208/DIG. 1; 208/48 Q; 208/62; 208/95; 208/108; 208/133; 208/134; 208/212; 585/26; 585/320; 585/950

[58] Field of Search ..... 203/4, 6, 8; 208/134, 208/212, 48 R, 48 AA, 95, 106–113, 133; 585/26, 320, 950

[56] References Cited

U.S. PATENT DOCUMENTS

| | | | |
|---|---|---|---|
| 1,672,801 | 6/1928 | Buerger | 208/48 R |
| 2,953,514 | 9/1960 | Wilkins | 208/95 |
| 3,152,980 | 10/1964 | Coonradt et al. | 208/78 |
| 3,155,604 | 11/1964 | Coonradt et al. | 208/78 |
| 3,197,518 | 7/1965 | Chapman et al. | 585/400 |
| 3,322,842 | 5/1967 | Czakowski et al. | 585/488 |
| 3,619,407 | 11/1971 | Hendricks et al. | 208/48 R |
| 3,725,247 | 4/1973 | Johnson et al. | 208/111 |
| 3,998,722 | 12/1976 | Mayer et al. | 208/112 |

*Primary Examiner*—O. R. Vertiz
*Assistant Examiner*—G. E. Schmitkons
*Attorney, Agent, or Firm*—Marthe L. Gibbons

[57] ABSTRACT

Coronene deposits are removed from a heat exchange zone of a reforming process by operating the reforming zone at conditions such that at least a portion of the reformer effluent condenses in the heat exchange zone where the coronene deposit occurs.

7 Claims, 2 Drawing Figures

METHOD FOR REMOVING CORONENE FROM HEAT EXCHANGERS

BACKGROUND OF THE INVENTION

1. Field of the Invention

The present invention relates to a method for removing coronene deposits from a heat exchange zone of a reforming process.

2. Description of the Prior Art

Reforming is a well known process in which a hydrocarbonaceous feedstock, such as naphtha, is contacted at elevated temperature and pressure in the presence of added hydrogen with a solid catalyst to increase the aromaticity of the feedstock. See, for example, *Hydrocarbon Processing*, September 1976, pages 171–178. The effluent of the reforming zone comprises undesired polycyclic aromatic compounds, including coronene, in amounts which vary depending on the operating conditions. Coronene ($C_{24}H_{12}$) is a polycyclic aromatic compound having a structure which contains 7 benzene rings in a circular pattern with no side chains. Its molecular weight is 300 and its melting point is 440° C. Because of its high melting point, when coronene is present in relatively high concentrations, coronene readily deposits as a solid upstream of the effluent dew point in the heat exchanger used to cool the effluent.

U.S. Pat. No. 3,332,842 discloses recycling a portion of the gasoline reformate to the total reaction effluent prior to separating the reaction product into gaseous phase and liquid phase to minimize catalyst deactivation caused by polycyclic aromatic compounds such as coronene.

U.S. Pat. No. 1,672,801 discloses the use of a solvent, such as naphtha, to dissolve asphalt in clogged drawoff pipes or separation zones of hydrocarbon conversion processes.

U.S. Pat. No. 3,725,247 discloses that polynuclear aromatics which have a deleterious effect on the catalyst are formed during hydrocracking. It teaches treatment of the catalyst to avoid formation of polyaromatic compounds.

U.S. Pat. No. 2,953,514 relates to a method of reducing heat exchanger fouling. It discloses injecting a portion of the liquid reformate boiling at least above 450° F. in the stream of the reactor effluent at a point upstream of the heat exchanger.

It has now been found that by maintaining the dew point of the effluent of the reformer at a dew point temperature such that at least a portion of the effluent condenses to a liquid in the fouled portion of heat exchanger, the deposit of coronene in the heat exchanger can be removed.

SUMMARY OF THE INVENTION

In accordance with the invention there is provided a method for removing a coronene deposit in a reforming process which comprises the steps of:

(a) contacting a hydrocarbonaceous feedstock with a catalyst in the presence of added hydrogen at reforming conditions in a reforming zone;

(b) passing the resulting total reforming zone effluent into a heat exchanger zone, said reforming zone effluent comprising coronene, at least a portion of which deposits in said heat exchange zone;

(c) separating the heat exchanged total reforming zone effluent into a hydrogen-rich gaseous phase and a liquid hydrocarbon phase comprising normally liquid hydrocarbons and normally gaseous hydrocarbons, the improvement which comprises maintaining the dew point of said reforming zone effluent at a temperature such that at least a portion of said reforming zone effluent condenses to a liquid phase in said portion of the heat exchange zone of step (b) having said coronene deposit, for a time sufficient to remove at least a portion of said coronene deposit from said portion of heat exchange zone.

DESCRIPTION OF THE PREFERRED EMBODIMENT

The preferred embodiment will be described with reference to the accompanying drawings.

Figure 1:
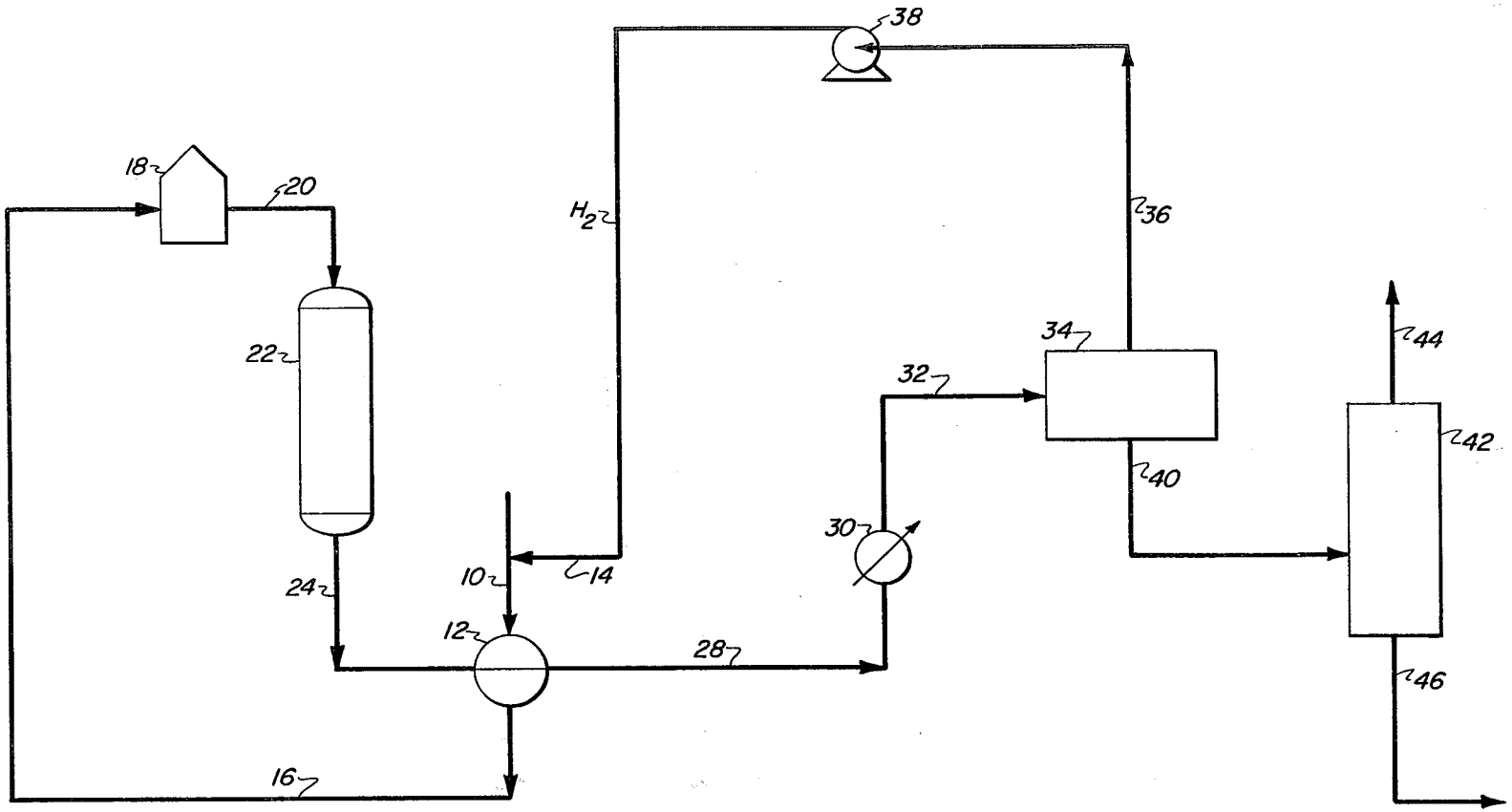
FIG. 1 is a schematic flow plan of one embodiment of the invention.

Referring to FIG. 1, a conventional reformer feed is passed via line 10 into the shell of heat exchanger 12. Although only one heat exchanger is shown in the drawing, the heat exchanging may occur in a series of heat exchange zones, as is well known in the art. A hydrogen-rich recycle gas is introduced into line 10 via line 14. Suitable reforming feeds include naphtha having an atmospheric pressure boiling point ranging from about 80° to about 450° F., preferably from about 150° to about 375° F. Generally the feed is substantially sulfur-free, that is, the feed comprises less than about 25 wppm, preferably less than 10 wppm sulfur. In the shell of heat exchanger 12, the naphtha feed and hydrogen-rich gas are partially preheated and passed via line 16 to furnace 18 in which the mixture of naphtha feed and hydrogen-rich gas is additionally heated to reforming reaction temperature. The heated stream is passed via line 20 into reforming reactor 22 in which is disposed a bed of reforming catalyst. The reforming catalyst may be any of the known reforming catalysts. Suitable reforming catalysts include metals such as platinum or palladium, oxides and sulfides of certain metals such as molybdenum, chromium, vanadium and tungsten. The catalysts may be a multi-metallic catalysts such as catalysts comprising platinum, rhenium or iridium composited with a suitable support such as alumina. The catalyst may comprise a halogen component such as chlorine. Conventional reforming conditions include a temperature ranging from about 750° to 1050° F., a pressure ranging from about 50 to about 600 psig, a space velocity (volumes of liquid feed per volume of catalyst per hour) of from 0.5 to 10. The reforming reaction is conducted in the presence of added hydrogen or added hydrogen-rich gas. The hydrogen concentration can vary from about 1000 to about 10,000 standard cubic feet per barrel of reformer feed. During the reforming process, naphthenes are dehydrogenated to the corresponding aromatics, paraffins are isomerized and aromatized, olefins are hydrogenated and some hydrocracking of high boiling constituents occurs. The reforming reaction also produces hydrogen. Undesired polycyclic aromatics such as coronene are produced during the reforming reaction. The coronene content in the effluent may vary from about 0.1 to about 20 wppm. When the content of coronene in the reformer effluent is relatively high, that is, at least 0.5 wppm, coronene may precipitate out from the effluent to the surface of the heat exchanger. In accordance with the present invention, the deposit of solid coronene from the surface of the heat exchanger is removed by controlling the dew point of the effluent of the reformer to be at a temperature such that at least a portion of the reformer effluent will condense to a liquid in the portion of the heat exchanger where the coronene deposit is located. The appropriate dew point will vary widely depending on the operating pressure and on the feed end point and gas rate. The dew point of the reformer effluent is increased so that a liquid will condense at a higher temperature. The normal or typical dew point of the reforming zone effluent generally ranges from about 200° to about 400° F., typically from about 800° to about 350° F. To effect partial condensation of the reforming zone effluent, the dew point is increased from about 10 to about 100 Fahrenheit degrees, preferably from about 15 to about 50 Fahrenheit degrees, relative to the actual dew point of the reforming zone effluent. Thus, if the actual average reforming zone effluent dew point is about 320° F., the dew point would be increased by 10 to 100 Fahrenheit degrees to effect partial condensation. The effluent dew point can be increased by increasing the operating pressure of the reformer, decreasing the gas recycle rate and/or increasing the feed end point.

For example, the following change in operating conditions can be employed:

| | Normal Operation | Coronene Removal Operation |
|---|---|---|
| Feed end point, °F. | 330 | 360 |
| Recycle gas rate, KSCF/B | 8 | 5 |
| Effluent dew point, °F. | 303 | 347 |

Operating the reformer such as to increase the reformer effluent dew point can be conducted intermittently to dissolve already formed coronene deposits. The effluent of heat exchanger 12 is passed via line 28 through cooler 30 and then via line 32 to separation zone 34 where the effluent is separated by conventional means into a gaseous phase and liquid phase. The gaseous phase rich in hydrogen is removed from separation zone 34 by line 36, passed to compressor 38 and recycled via line 14 into naphtha feed line 10. The liquid hydrocarbon phase comprising aromatics, light paraffins, olefinic hydrocarbons and butanes is withdrawn from separator 34, passed by line 40 into separation zone 42 wherein light paraffins, olefinic hydrocarbons and at least a portion of the butanes are removed via line 44. The remaining liquid reformate product (stabilized reformate) is removed by line 46.

Since coronene deposits decrease the heat transfer efficiency of heat exchangers, removal of coronene deposits by the method of the present invention improves the heat transfer in the feed-effluent exchangers. When the coronene deposit is substantially completely removed, heat transfer efficiency may be restored to the level of unfouled heat exchangers.

EXAMPLE 1

Tests were conducted at conditions given in Table I. The results of these tests are summarized in Table I. In the column labeled "Normal Operation", typical reforming conditions were used. In the column labeled "Test Operation", reforming conditions were changed to increase the dew point of the reformer effluent. Within two hours after the operating conditions were changed, reformate coronene had increased from 0.9 wppm to 55 wppm and the coronene number was still rising and the test was terminated after two hours. This test showed that coronene deposits can be removed from the surface of the equipment when the operating conditions are controlled such as to increase the dew point of the reformer effluent.

TABLE I

| | Normal Operation | Test Operation |
|---|---|---|
| Time | Till 10 a.m. After 12 p.m. | 10 a.m.–12 p.m. |
| Feed Rate, kB/D | 23.2 | 25.2 |
| Recycle Rate, kSCF/B | 7.06 | 5.51 |
| Feed Cut Point, °FVT | 155/330 | 155/360 |
| Reactor Inlet Temp., °F. | 923 | 910 |
| Reformate RONC | 96.1 | 93.2 |
| Reformate Coronene, wppm | | |
| 0800 | 0.9 | |
| 1020 | | 4.1 |
| 1040 | | 16.0 |
| 1100 | | 33.7 |
| 1125 | | 44.6 |
| 1155 | | 55.3 |
| 1530 | 0.9 | |
| Reactor Outlet Coronene | | |
| 1130 | | 1.4 |

EXAMPLE 2

Figure 2:
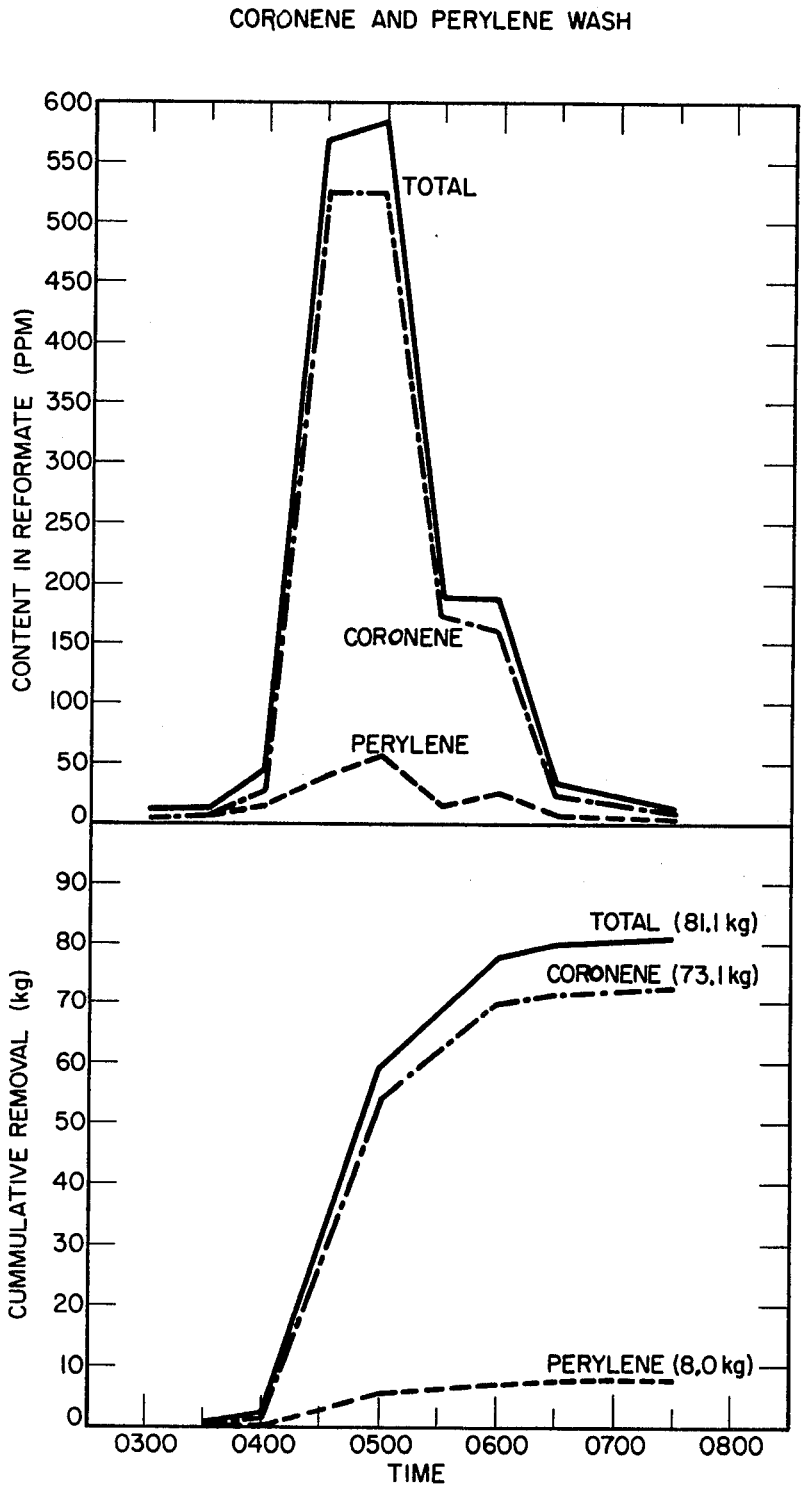
FIG. 2 is a graph showing coronene and perylene removal relative to time.

A coronene wash removal test was conducted by changing operation conditions as follows: a reduction in reformer outlet temperature from 490° C. to 460° C., a recycle rate decrease from 7 kSCF/B to 3.5 kSCF/B and a feed cut point increase to about 200° C. The test conditions resulted in a significant increase in effluent dew point. The removal of coronene and perylene as a function of time during this test period is shown in FIG. 2. During the test period of about 4 hours, a total of 81 kilograms of materials were removed, of which 73 kilograms were coronene.

What is claimed is:

1. A method for removing a coronene deposit in a reforming process which comprises the steps of:

(a) contacting a hydrocarbonaceous feedstock with a catalyst in the presence of added hydrogen at reforming conditions in a reforming zone;

(b) passing the resulting total reforming zone effluent into a heat exchange zone, said reforming zone effluent comprising coronene, at least a portion of which deposits in a portion of the heat exchange zone;

(c) separating the heat exchanged total reforming zone effluent into a hydrogen-rich gaseous phase, and a liquid hydrocarbon phase comprising normally liquid hydrocarbons and normally gaseous hydrocarbons, the improvement which comprises maintaining the dew point of said reforming zone effluent at a temperature such that at least a portion of said reforming zone effluent condenses to a liquid phase in said portion of the heat exchange zone of step (b) having said coronene deposit, for a time sufficient to remove at least a portion of said coronene deposit from said portion of heat exchange zone.

2. The method of claim 1 wherein said dew point is maintained at a temperature such that at least a portion of said reforming zone effluent condenses to a liquid phase for a time sufficient to remove substantially all of the coronene deposit from said heat exchange zone.

3. The method of claim 1 wherein prior to maintaining said dew point at a temperature such that at least a portion of said reforming zone effluent condenses, said dew point ranges from about 200° to about 400° F., and wherein said dew point is increased from about 10° F. to about 100° F. above the actual dew point to produce said partial condensation.

4. The method of claim 1 wherein said coronene is present in said total reforming zone effluent in an amount of at least 0.5 wppm prior to step (b).

5. The method of claim 1 wherein said coronene removal method is conducted intermittently in said reforming process.

6. The method of claim 1 wherein said hydrocarbonaceous feedstock is a naphtha having an atmospheric pressure boiling point ranging from about 80° to about 450° F.

7. The method of claim 1 wherein said hydrocarbonaceous feedstock is a naphtha having an atmospheric pressure boiling point ranging from about 150° to about 375° F.

* * * * *